US008061436B2

(12) United States Patent
Zannini et al.

(10) Patent No.: US 8,061,436 B2
(45) Date of Patent: Nov. 22, 2011

(54) MOBILE BASKET FOR CONSOLIDATION WORK ON WALLS

(76) Inventors: Roberto Zannini, Cismon del Grappa (IT); Rezia Molfino, Genoa (IT); Enzo Rizzi, Basiliano (IT); Giorgio Pezzuto, Genoa (IT); Manuel Armada, Arganda del Rey (ES); Pasqualino Comacchio, Riese Poi X (IT)

( * ) Notice: Subject to any disclaimer, the term of this patent is extended or adjusted under 35 U.S.C. 154(b) by 694 days.

(21) Appl. No.: 11/573,205

(22) PCT Filed: Aug. 6, 2004

(86) PCT No.: PCT/IT2004/000450

§ 371 (c)(1),
(2), (4) Date: Oct. 28, 2008

(87) PCT Pub. No.: WO2006/013594

PCT Pub. Date: Feb. 9, 2006

(65) Prior Publication Data

US 2009/0090526 A1 Apr. 9, 2009

(51) Int. Cl.
*E21B 19/087* (2006.01)

(52) U.S. Cl. ..... 173/37; 166/77.51; 175/52; 180/41

(58) Field of Classification Search ..... 173/37, 173/31, 213; 175/52; 180/41; 166/77.51; 414/22.51, 22.71

See application file for complete search history.

(56) References Cited

U.S. PATENT DOCUMENTS

| | | | | | |
|---|---|---|---|---|---|
| 2,781,185 | A | * | 2/1957 | Robbins | 175/52 |
| 2,849,212 | A | * | 8/1958 | Robbins | 173/198 |
| 3,265,138 | A | * | 8/1966 | Alexander et al. | 175/52 |
| 3,563,319 | A | * | 2/1971 | Nixon | 173/185 |
| 3,741,320 | A | * | 6/1973 | Hilfing | 175/6 |
| 3,741,322 | A | * | 6/1973 | Wolters | 175/52 |
| 3,913,753 | A | * | 10/1975 | Swartz et al. | 414/22.66 |
| 3,913,754 | A | * | 10/1975 | Swartz et al. | 414/22.66 |
| 3,965,994 | A | * | 6/1976 | Hilding | 175/52 |
| 3,976,149 | A | * | 8/1976 | Granholm et al. | 483/38 |
| 3,986,569 | A | * | 10/1976 | Hilding et al. | 175/52 |
| 4,049,065 | A | * | 9/1977 | Walter | 175/52 |
| RE30,071 | E | * | 8/1979 | Hilding et al. | 175/52 |
| 4,257,618 | A | * | 3/1981 | Tax et al. | 280/6.155 |
| 4,265,326 | A | * | 5/1981 | Lauber | 180/8.3 |
| 4,266,627 | A | * | 5/1981 | Lauber | 180/8.3 |
| 4,290,495 | A | * | 9/1981 | Elliston | 175/85 |
| 4,420,277 | A | * | 12/1983 | Hibbard et al. | 405/259.5 |
| 4,476,940 | A | | 10/1984 | Reichert et al. | |

(Continued)

FOREIGN PATENT DOCUMENTS

RU 2099230 C1 * 12/1997

*Primary Examiner* — Lindsay Low
(74) *Attorney, Agent, or Firm* — Themis Law

(57) ABSTRACT

A mobile basket for consolidation work on walls is provided with a main frame, configured in the front part for hoisting and for translating the new basket up and down a wall and having legs fitted on the sides of said main frame. A secondary frame or cage is structured for supporting a magazine of drill rods, as well as a mast or drill and a mechanical hand applied to the secondary frame or cage positions parallel to its longer side and essentially perpendicular to the main frame. The mechanical hand, positioned between the mast or drill and the magazine, is configured to take a rod from the magazine and transfer it to the mast or drill.

7 Claims, 6 Drawing Sheets

U.S. PATENT DOCUMENTS 4,645,084 A * 2/1987 Deike ..... 212/271
4,650,017 A * 3/1987 Pelletier et al. ..... 180/9.1
4,790,400 A * 12/1988 Sheeter ..... 180/8.6
4,974,686 A * 12/1990 Hisey et al. ..... 173/164
4,986,374 A * 1/1991 Niemi et al. ..... 175/86
5,137,101 A * 8/1992 Schaeff ..... 180/8.1
5,174,389 A * 12/1992 Hansen ..... 175/52
5,246,313 A * 9/1993 Combet et al. ..... 405/303
5,263,545 A * 11/1993 Tudora et al. ..... 175/52
5,346,027 A * 9/1994 Da et al. ..... 180/8.2
5,921,337 A * 7/1999 Okamoto ..... 180/41
6,074,153 A * 6/2000 Allen ..... 414/22.53
6,085,852 A * 7/2000 Sparks et al. ..... 175/52
6,223,837 B1 * 5/2001 Lanzl ..... 175/52
6,311,788 B1 * 11/2001 Weixler ..... 175/52
6,581,698 B1 * 6/2003 Dirks ..... 175/52
6,609,565 B1 * 8/2003 Andreychuk et al. ..... 166/77.2
6,845,825 B2 * 1/2005 Bischel et al. ..... 175/24
7,617,887 B2 * 11/2009 Piipponen ..... 175/57
7,631,704 B2 * 12/2009 Hagemeyer et al. ..... 175/52
2003/0094316 A1 * 5/2003 Schneider ..... 180/41
2004/0069917 A1 * 4/2004 Osen ..... 248/274.1
2006/0283614 A1 * 12/2006 Hinshaw et al. ..... 173/184
2006/0283634 A1 * 12/2006 Hinshaw et al. ..... 175/58
2009/0032277 A1 * 2/2009 Ferrand ..... 173/185
2011/0030982 A1 * 2/2011 Ferrand ..... 173/34

* cited by examiner

MOBILE BASKET FOR CONSOLIDATION WORK ON WALLS

FIELD OF THE INVENTION

The present invention concerns a mobile basket for work on rocky walls, such as drilling, scaling, and the laying of netting, cables and structures for consolidation. In particular, the present invention concerns a new basket, with autonomous movement independent of supporting structures, that is provided with devices designed to improve its stability and adherence to the wall, and also to improve its dependability, work capacity and safety.

BACKGROUND OF THE INVENTION

Stretches of roads or railways or other installations below rocky walls can be endangered by the instability of the wall above. To prevent fragments and portions of a rocky wall from falling onto stretches of road or railway or on the installations below, the rocky wall is consolidated with netting and cables laid on the wall in order to contain it. Said netting and cables are fixed at intervals over the surface of the wall by means of active and/or passive tie rods driven into the wall.

To correctly lay the netting and cables and to position the tie rods in the rocky wall, two methods are currently used. One method consists in the laying of ground supporting structures, such as tubular scaffolding, for the personnel and machinery. The other method makes use of mobile suspended baskets, which move vertically up and down the wall to be consolidated.

Said baskets consist mainly of a parallelepiped metal structure, suspended at the top of the wall to be consolidated by means of supporting cables; the basket is vertically translated up and down the rocky wall by means of cables operated by one or more hoisting elements. The metal structure of the basket is designed to accommodate the personnel assigned to consolidation of the wall, in addition to the machinery and tools, including the material necessary for laying and affixing the netting and cables to the rocky wall and for the performance of the drilling operations.

The known suspended baskets are provided, on the side facing the rocky wall, with sliding blocks or guides designed both to facilitate translation of the basket up and down the rocky wall and to improve the stability of the basket on the rocky wall during the various consolidation operations. These baskets are also provided with a series of extendible pistons used both to facilitate movement and to stabilize the basket. The above baskets have a number of drawbacks that complicate operations for perfect execution of consolidation work and force the operators to perform several vertical translations up and down the wall and to adopt intricate and complicated stratagems, which at times put their own safety at risk.

In addition to these drawbacks, the current baskets expose the operators to harmful effects deriving from the work carried out, dust and noise, and to the risks inherent in the wall itself, collapse and landslides of portions at risk.

The main problem that the known baskets have to overcome is the continuous variation in configuration due to the irregularity of the rocky wall to be consolidated at the various points along the path of the basket.

Another drawback of the known baskets is the difficulty of reaching, even only occasionally and/or temporarily, areas immediately adjacent to the vertical path of the basket without translating the lifting unit installed at the top of the rocky wall. During consolidation of the wall, situations may occur that cannot be predicted in advance and consequently it is not possible to program with absolute certainty the vertical bands covered by the path of the basket unless each path is amply overlapped with the adjacent ones.

A further drawback of the known baskets consists in the difficulty of the basket, during its vertical translation, of overcoming sudden changes in gradient such as parts jutting out, recesses or projections, ledges or niches.

BRIEF SUMMARY OF THE INVENTION

To remedy all the above drawbacks, a new mobile basket has been designed and produced for consolidation work on rocky walls.

One aim of the new mobile basket is to perform the operations on the rocky wall without the direct intervention of persons, or without the need for persons on board of the basket.

Another aim is to prevent harmful effects, dust and noise, and the risks inherent in the consolidation work for the site personnel.

Still another aim of the new mobile basket is to facilitate the overcoming of projections, ledges, recesses or other sudden variations in gradient of the rocky wall.

Yet another of the new mobile basket is to achieve the capability to translate laterally, in order to reach areas of the rocky wall to be consolidated that are immediately adjacent to the vertical band covered by the path of the basket, without having to translate the lifting unit installed at the top of the rocky wall.

A further aim of the new mobile basket is to maintain a substantially vertical configuration even on stretches of the rocky wall that are not vertical.

A still further aim of the new mobile basket is to permit the consolidation or application of anchors at an angle with respect to the face of the rocky wall.

A yet further aim of the new mobile basket is to permit several consolidations and/or applications of anchors along the same up-down path without having to move vertically each time to load the tools and/or anchors.

These and other aims, direct and complementary, are achieved by the new mobile basket for consolidation work on rocky walls that includes a main frame, provided with spacers and lateral translation devices, and a secondary frame or cage with a drilling unit generally perpendicular and slantable with respect to the main frame.

The spacers and lateral translation devices, subsequently called legs, permit positioning and position adjustments of the new mobile basket in relation to the local configuration of the rocky wall. The angle of the secondary frame or cage with the drilling unit positioned on the main frame is adjusted by a worm screw jack.

The cage supports the drilling unit comprising the mast or drill, a magazine of drilling rods parallel to the mast, and a mechanical hand that takes the rod from the magazine and positions it on the mast or drill for application at the preselected point on the rocky wall.

The mechanical hand consists of a slide, sliding perpendicularly to the rods stored in the magazine, and is provided with three fingers, two of which are side by side and fixed, and the third of which can be rotated between the first two in order to retain each rod between said two fixed fingers and the third rotating finger.

The new mobile basket is suspended from cables, fixed on the upper part of the wall, wound and blocked by hoisting devices present on the upper front part of the main frame.

BRIEF DESCRIPTION OF THE SEVERAL VIEWS OF THE DRAWINGS

The characteristics of the new mobile basket for consolidation work on rocky walls will be better illustrated by the following description with reference to the drawing attached as a non-restrictive example.

FIG. 4 is a perspective view of a drilling rod magazine according to one embodiment of the invention, while

DETAILED DESCRIPTION OF EMBODIMENTS OF THE INVENTION

Detailed descriptions of embodiments of the invention are provided herein. It is to be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, or manner.

Figure 1:
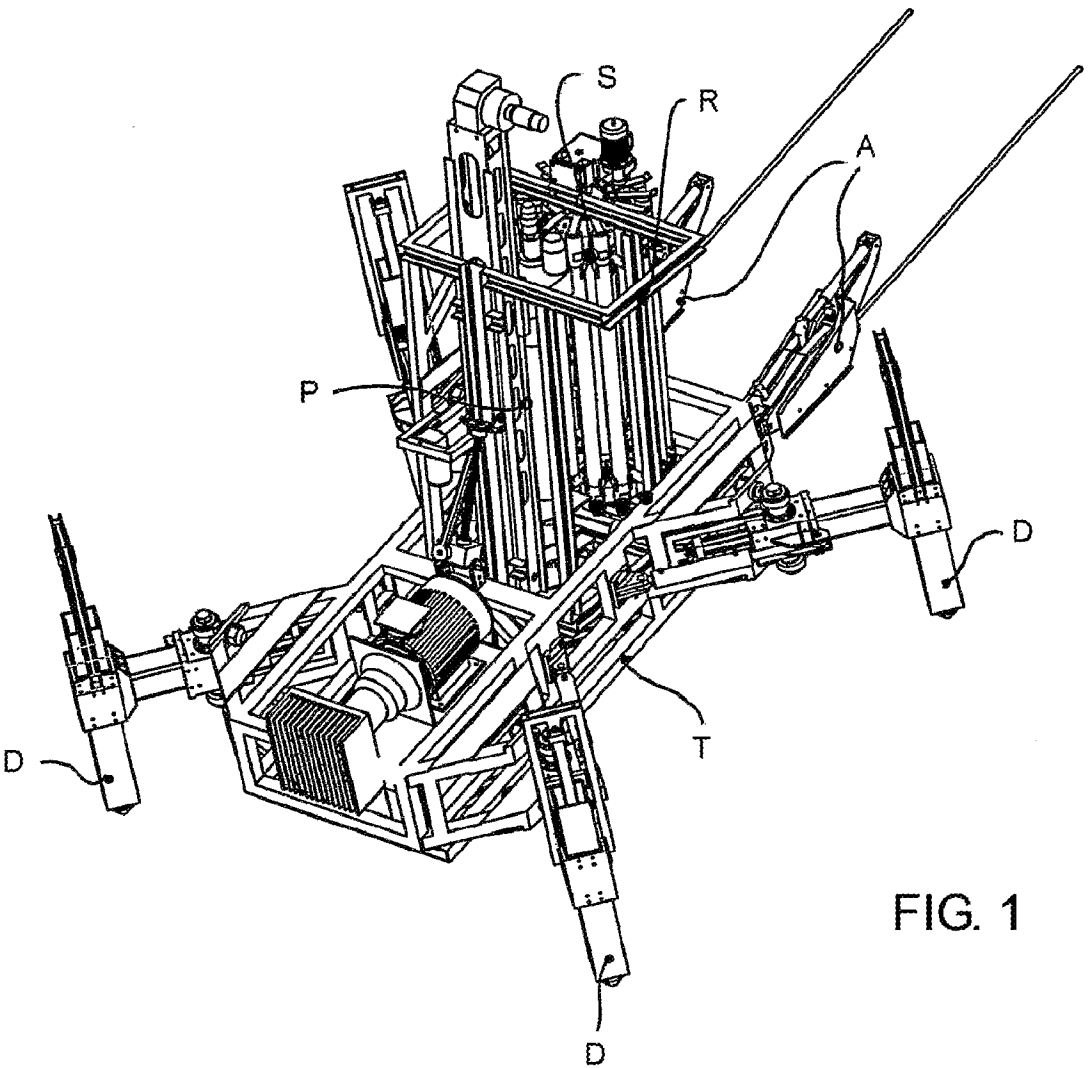
FIG. 1 is a perspective view of an embodiment of the invention.
Figure 6:
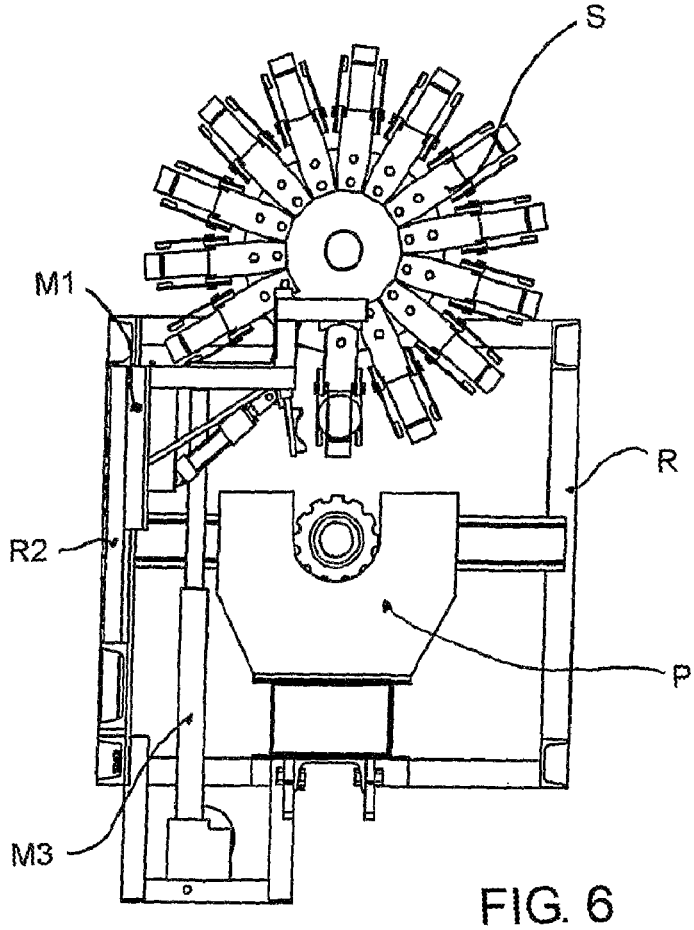
FIG. 6 is a side view of a detail of the embodiment of FIG. 1, showing a hand for picking and delivering a drill rod.
Figure 7A:
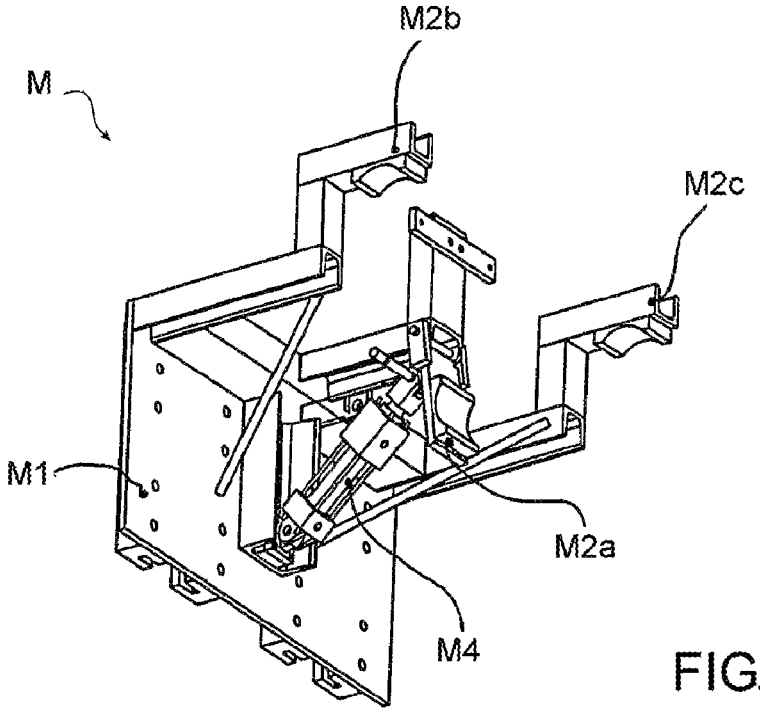
FIGS. 7*a*-7*b* are perspective views of different operational stages of the hand of FIG. 6.
Figure 7B:
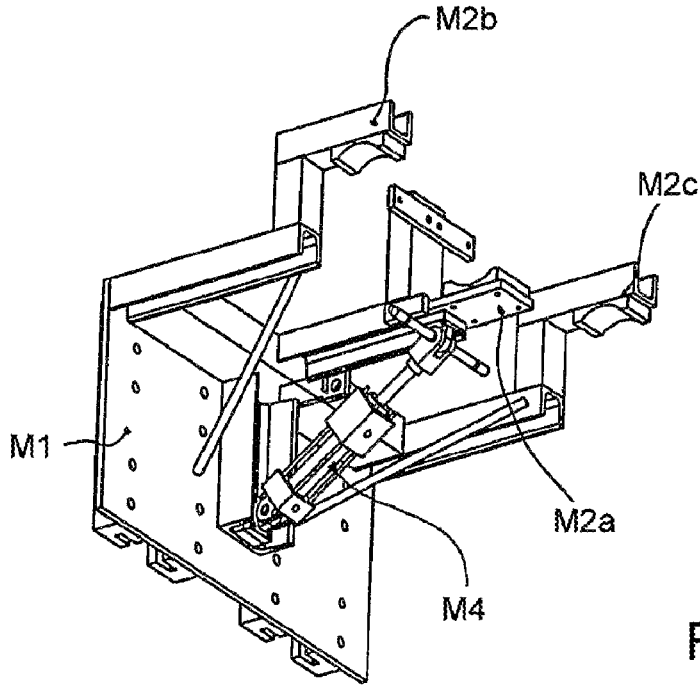

FIG. 1 shows a perspective view of an embodiment of the new mobile basket comprising a main frame (T), provided with side legs (D), on which a secondary frame or cage (R) is hinged generally perpendicular and slantable with respect to the main frame (T). Said cage (R) houses both the rod magazine (S) and the mast or drill (P), and a mechanical hand (M), illustrated in FIGS. 6, 7*a* and 7*b*, configured to transfer each rod from the magazine (S) to the mast or drill (P).

In the front part of the main frame (T), hoisting and/or grip devices (A) are present for connecting and anchoring of the new basket to cables fixed at the top of the rocky wall and for translation of the new basket up and down the wall.

Figure 2:
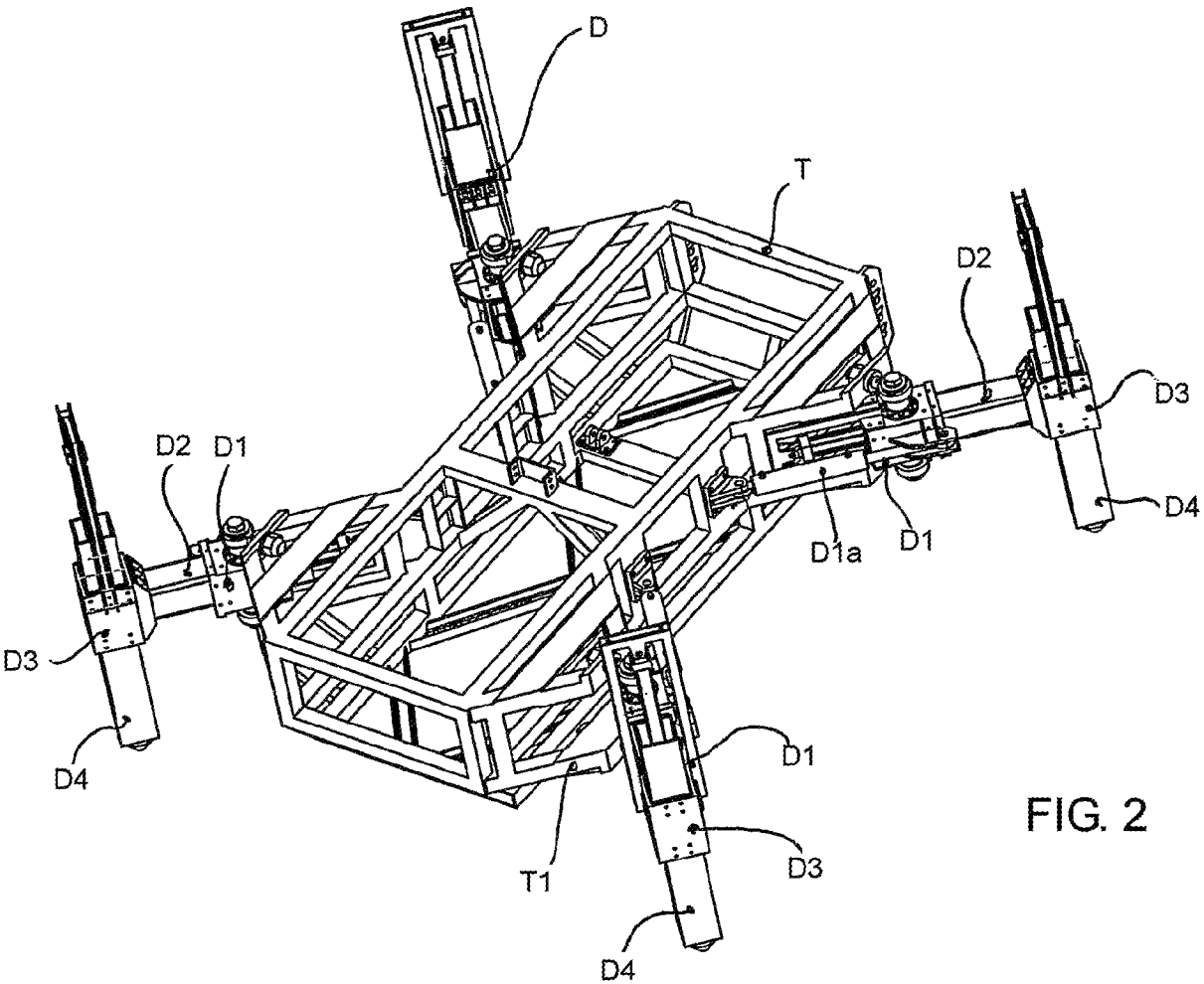
FIG. 2 is a perspective view of the main frame of the mobile basket of FIG. 1.

FIG. 2 illustrates in detail only the main frame (T), consisting of metal profiles assembled to form a grid structure which is generally a rectangular parallelepiped. The main frame (T) is provided, preferably on the longer sides and generally near the corners, with four housings with generally triangular shape (T1) in which the side legs (D) are hinged.

Each leg (D) comprises a support (D1), which is hinged to the frame-structure (T) and which can be rotated on the horizontal plane by means of a hydraulic, mechanical or pneumatic actuator (D1*a*).

Coaxially, or beside said support (D1), there is a second telescopic element (D2) provided at the end, facing in the direction opposite to the main frame (T), with a vertical guide (D3). The sliding movement of said second telescopic element (D2) is provided by a hydraulic, mechanical or pneumatic actuator.

A thrust element (D4) is housed and runs within said vertical guide (D3), and its sliding is controlled by an appropriate hydraulic, mechanical or pneumatic actuator. The lower end of said thrust element (D4) is specially shaped or in any case designed to rest on the rocky wall. Each leg (D) constructed as above has three degrees of freedom: rotation, extension-retraction, and raising-lowering.

On the front part of the main frame (T), or on one of the two shorter sides of the parallelepiped structure of the main frame (T), at least two hoisting and/or grip devices (A) are applied and/or affixed and are configured to connect the new basket to the cables for descent and ascent of said new basket running on said cables up and down the rocky wall.

Figure 3A:
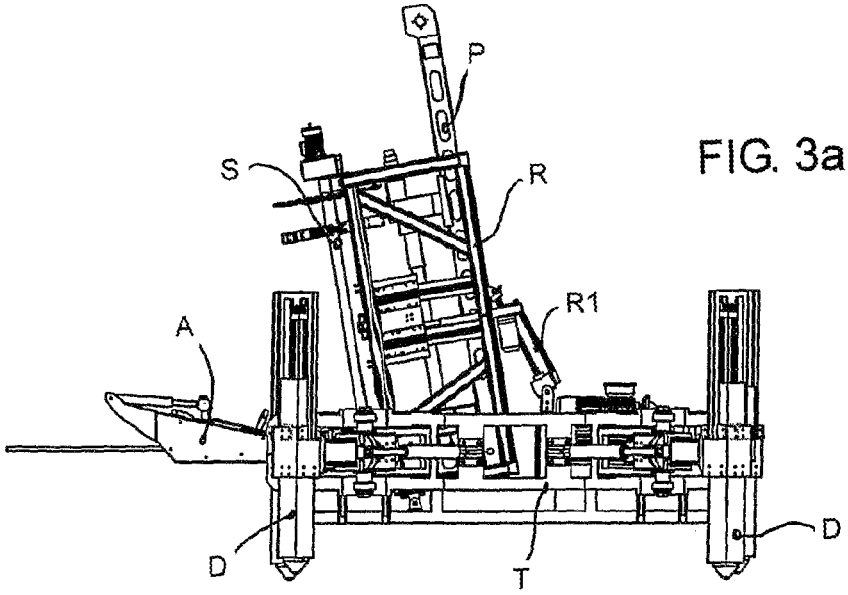
FIGS. 3*a* and 3*b* are side views of the embodiment of FIG. 1, in which the cage is oriented at different angles.
Figure 3C:
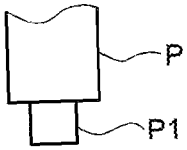
FIG. 3*c* is a detail view of the mast or drill with the drill bit connected thereto.
Figure 3B:
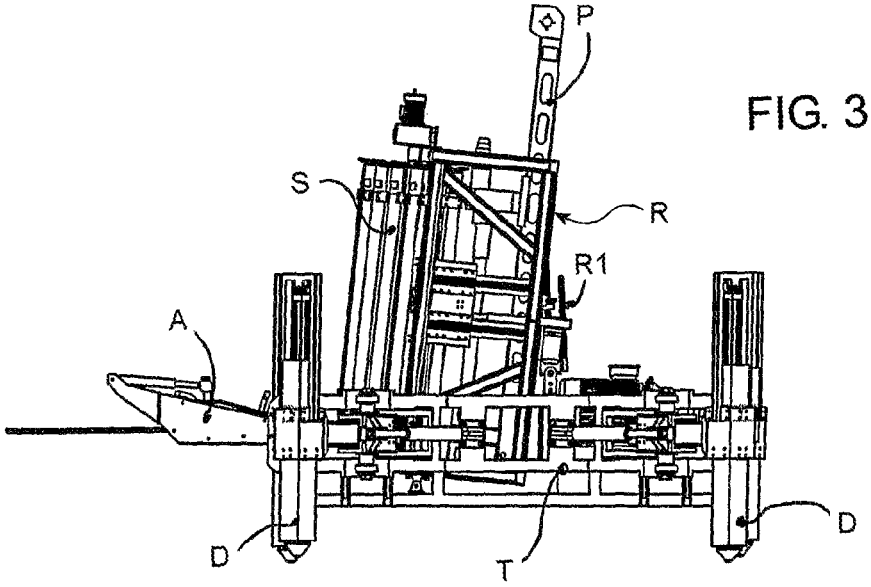

Referring now to FIGS. 3*a* and 3*b*, the cage (R) is typically hinged to the central part of the main frame (T). Said cage (R) consists of a series of metal profiles constituting a frame, which is substantially parallelepiped and developed in a generally perpendicular direction to the main frame (T).

Said cage (R) is hinged to the main frame (T), so that it rotates on a horizontal axis perpendicular to the two longer sides of the main frame (T). The angle of rotation of said cage, roughly between +10° and −5°, is obtained and adjusted by a hydraulic, pneumatic or mechanical mechanism, preferably a worm screw jack (R1), as can be seen in FIGS. 3*a* and 3*b*.

Said cage (R) is configured to support the rod magazine (S), the mast or drill (P), and a mechanical hand (M) structured for transferring each drilling rod from the magazine (S) to the mast or drill (P).

The mast or drill (P) consists preferably of a rotation head, driven by a hydraulic motor, to which a drill bit P1 is connected (See FIG. 3*c*) and configured to drill into the rocky wall. Said mast or drill (P) is applied to the cage (R) parallel to its longer side so that it is essentially perpendicular to the main frame (T).

Figure 4:
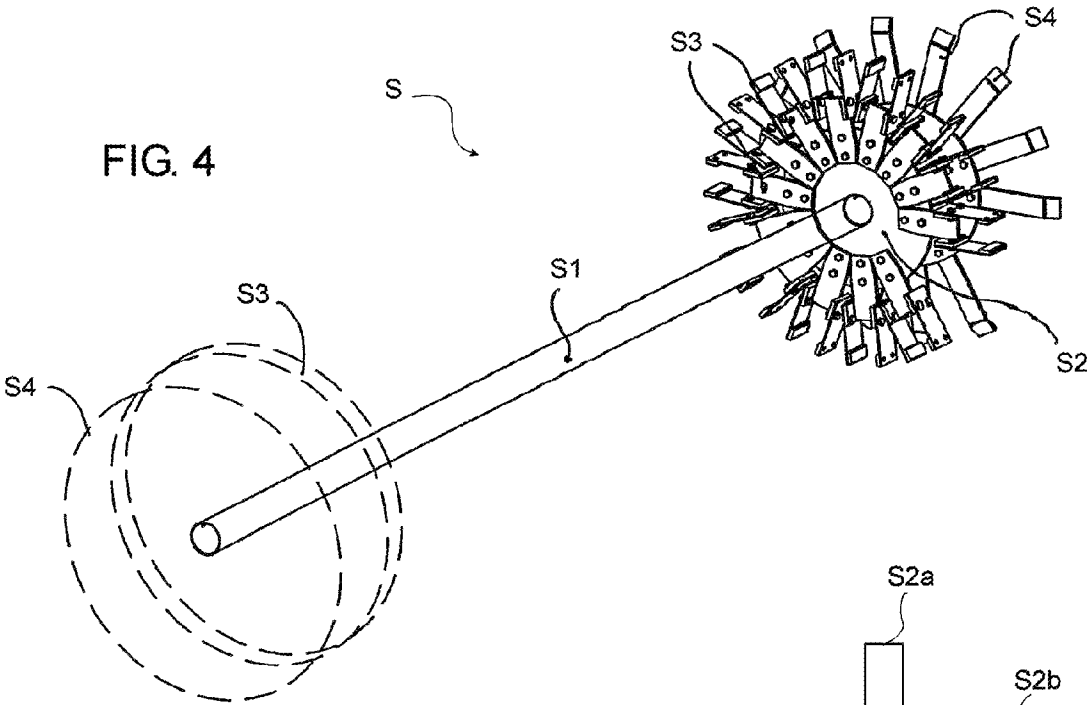

The rod magazine (S) is also applied to the cage (R), parallel to its longer side so that it is essentially perpendicular to the main frame (T) and parallel to the mast or drill (P). The drilling rod magazine (S), shown schematically in FIG. 4, consists mainly of a shaft (S1) having, near its ends, two hubs (S2) for connection with various supports (S3) for housing the rods.

Figure 4A:
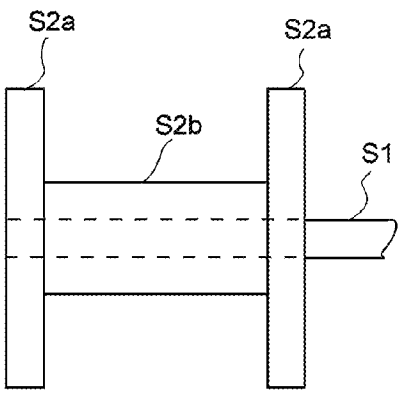
FIG. 4*a* is a detail view of some constituent parts of an end segment of the drilling rod magazine of FIG. 4.

As shown schematically in FIG. 4*a*, each hub (S2) consists substantially of two discs (S2*a*) parallel and interconnected by a tubular section (S2*b*). The hub constructed as above is housed on the shaft (S1) so that said shaft (S1) crosses said tubular section (S2*b*) of the hub (S2).

Figure 5:
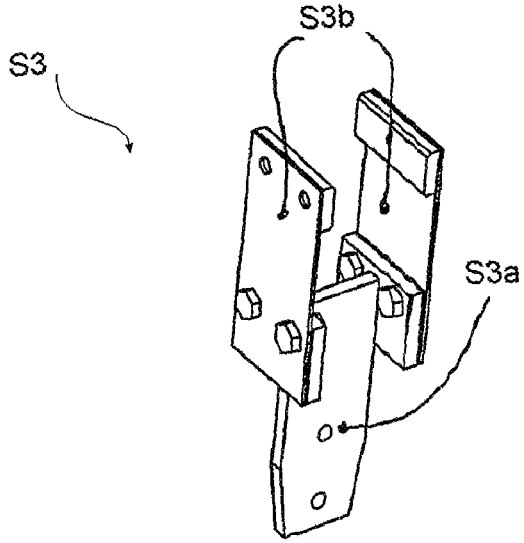
FIG. 5 is a perspective view of a rod support element according to one embodiment of the invention.

The various supports (S3) for housing the rods are applied radially on each hub (S2). Each support (S3), shown schematically in FIG. 5, consists of a connection element (S3*a*) to which two elastic plates (S3*b*) are joined, parallel and protruding beyond the connection element (S3*a*) and each provided at the end with a raised element facing the plate (S3*b*) opposite.

Each support (S3) is applied and joined to the hub (S2), so that the plates (S3*b*) are radial with respect to the hub (S2) and so that said plates are perpendicular to the shaft (S1) of the magazine (S).

The set of the two series of supports (S3) of the two hubs (S2) house and retain a series of drilling rods, arranged parallel to the shaft (S1) of the magazine (S). Substantially each connection element (S3*a*) and its two plates (S3*b*) constitute a generally U-shaped housing having a width sufficient to contain a rod. The ends of the two plates (S3*b*) are provided with raised element to ensure retention of each rod arranged parallel to the shaft (S1) of the magazine (S).

On each hub (S2), covering elements (S4) are also applied, radial and aligned with the supports (S3), configured to cover and protect the ends of the rods housed and retained in the magazine (S).

A corner portion of each of the hubs (S2), roughly 60° wide, is without supports (S3) and covering elements (S4), thus permitting access of the mechanical hand (M), in sequence, to the rods housed in the magazine (S). The magazine (S) constructed as above is rotated by a mechanism, preferably a gear motor.

The mechanical hand (M) is positioned between the mast or drill (P) and the magazine (S). The mechanical hand (M), shown schematically in FIGS. 6, 7*a*, 7*b*, consists of a slide (M1), sliding essentially perpendicular to the magazine (S) and to the mast or drill (P), and is provided with three fingers (M2*a*, M2*b*, M2*c*).

Two (M2*b*, M2*c*) of said fingers are disposed side by side, parallel and fixed to the structure of the slide (M1), while the third finger (M2*a*), intermediate with respect to said two (M2*b*, M2*c*), can be rotated on a plane perpendicular to the two fixed fingers (M2*b*, M2*c*). The end of each of the fingers (M2*a*, M2*b*, M2*c*) has a concave seat designed to adhere to and press on the surface of the rod.

An actuator (M3) translates the slide (M1) and the entire mechanical hand (M) along appropriate guides (R2) coupled to the cage (R), thus translating said mechanical hand (M) from the magazine (S) to the mast or drill (P) and vice versa, so that the three fingers (M2*a*, M2*b*, M2*c*), when positioned close to each other, are substantially aligned in a direction parallel to the shaft (S1) of the magazine (S) and to the drilling axis of the mast or drill (P). A further actuator (M4) rotates the third finger (M2*a*) with respect to the other two fixed fingers (M2*b*, M2*c*).

The mechanical hand (M) has the function of taking a rod from the magazine (S) each time and transferring it to the mast or drill (P).

Essentially, the mechanical hand (M) performs a series of coordinated movements to carry out said rod transfer. The magazine (S) is rotated so as to present the corner portion without rods facing the mechanical hand (M) and the mast or drill (P).

The third finger (M2*a*) of the mechanical hand (M) is opened, or moved away, by the other two (M2*b*, M2*c*). The mechanical hand (M) is translated towards the magazine (S) until the two fixed fingers (M2*b*, M2*c*) go beyond the circumference defined by the various rods of the magazine (S).

The magazine (S) is then rotated until the first rod available of the series is located between the two fixed fingers (M2*b*, M2*c*) and the mobile finger (M2*a*). Subsequently the mechanical hand (M) is translated until the two fixed fingers (M2*b*, M2*c*) come into contact with the rod, and then the actuator (M4) is operated to rotate the third finger (M2*a*) in order to grip said rod between the three fingers (M2*a*, M2*b*, M2*c*). Lastly, the mechanical hand (M) is translated towards the mast or drills (P), so that the rod is extracted from the supports (S3) of the magazine (S) and transferred to the mast or drill (P).

All the mechanisms such as actuators, motors and pistons of the new basket are controlled by a control unit, which supervises and combines the various movements and rotations. Said control unit is controlled by appropriate software developed to synchronize the movement of the extendible mechanisms with that of the retrieval elements.

The new mobile basket for consolidation work on rocky walls constructed as above has considerable advantages.

Thanks to said legs (D), the new mobile basket can be translated laterally with respect to the vertical band of its vertical path, thus reaching lateral adjacent areas. The new mobile basket can be slanted and rotated with respect to the surface of the rocky wall, by appropriately slanting and extending the thrust elements (D4) and/or appropriately slanting the cage (R), to facilitate the various consolidation operations on the rocky wall.

The new mobile basket can easily overcome any change in gradient, projections, ledges, recesses or other sudden variations in gradient of the rocky wall by appropriately slanting and extending the thrust elements (D4) of its legs (D). The new basket does not expose the site personnel to the harmful effects of the work processes and the danger inherent in remaining at length in a high risk area. The new mobile basket optimizes personnel efficiency and extends possible use to groups of persons currently not employed in this type of activity, such as female personnel and the disabled. By replacing the drilling unit with specifically designed elements, work can be carried out on the wall such as: sandblasting, application of gunite and concrete, pressure cleaning with water and solvents, painting, demolition and scaling etc.

These are the schematic procedures sufficient for a person skilled in the art to produce the invention; during actual application variations may be applied without affecting the scope of the invention.

While the invention has been described in connection with the above described embodiments, it is not intended to limit the scope of the invention to the particular forms set forth, but on the contrary, it is intended to cover such alternatives, modifications, and equivalents as may be included within the scope of the invention. With reference to the preceding description and the attached drawing, the following claims are therefore made.

What is claimed is:

1. A mobile basket for consolidation work on a wall comprising:

a main frame having a face and a plurality of sides, a plurality of hoisting/gripping devices extending from the sides, the hoisting/gripping devices being configured for connection to cables affixed to the wall and for translation of the basket up and down the wall;

legs coupled to the sides of said main frame, a support the legs to the main frame, the support being rotatably connected to an actuator, a telescopic element slidably coupling said support with said legs, a thrust element being slidably connected to the telescopic element and extending towards the wall in a direction essentially perpendicular to the telescopic element;

a secondary frame, configured for supporting a magazine of drilling rods, a drill, and a mechanical hand positioned essentially perpendicular to the main frame, the mechanical hand being hinged to the main frame;

the drill, applied to the secondary frame in a direction essentially perpendicular to the main frame, and having a drill bit for drilling the wall;

the magazine, having a shaft essentially parallel to the secondary frame and essentially perpendicular to the main frame, the magazine being configured for containing a plurality of drill rods; and the mechanical hand, positioned between the drill and the magazine, the mechanical hand being configured for taking a drill rod from the magazine and for transferring the drill rod to the drill wherein the shaft of the magazine has opposite ends, wherein a hub is situated near each end for connection with magazine supports housing the drill rods, wherein each hub comprises a plurality of discs parallel and interconnected by a tubular section, and wherein the magazine supports housing the drill rods are disposed radially on each hub.

2. The mobile basket for consolidation work a wall of claim 1, wherein a portion of each hub contains no supports, thereby permitting the mechanical hand to access the rods housed in the magazine.

3. The mobile basket for consolidation work on a wall of claim 1, wherein the mechanical hand comprises a slide, sliding essentially perpendicular to the magazine and to the drill, wherein a plurality of fingers extend from the slide, and wherein at least two of said fingers are side by side, parallel and affixed to the structure of the slide, and wherein at least one finger, in an intermediate position with respect to the at least two fingers, is rotatable on a plane perpendicular to the at least two fingers.

4. The mobile basket for consolidation work on a wall of claim 3, wherein an end portion of each of said plurality of fingers is provided with a concave seat configured to couple to and press on the surface of the drill rod.

5. The mobile basket for consolidation work on a wall of claim 3, wherein the actuator is hydraulic, pneumatic, mechanical or electrical.

6. The mobile basket for consolidation work on a wall of claim 3, wherein the magazine is rotatable and coupled to a hydraulic, pneumatic, mechanical or electrical actuator.

7. The mobile basket for consolidation work on a wall of claim 3, wherein a hydraulic, pneumatic, mechanical or electrical actuator causes a translation of the mechanical hand and an opening/closing of the at least one finger.

* * * * *